US005746504A

United States Patent [19]

Dodson

[11] Patent Number: 5,746,504

[45] Date of Patent: May 5, 1998

[54] CHRISTMAS TREE LIGHT RING

[76] Inventor: Esther L. Dodson, 219 N. Howell St., Owosso, Mich. 48867

[21] Appl. No.: 700,723

[22] Filed: Jul. 5, 1996

[51] Int. Cl.[6] ..... F21P 1/00; F21P 1/02; F21V 21/00

[52] U.S. Cl. ..... 362/252; 362/123; 362/249

[58] Field of Search ..... 362/123, 252, 362/249; 315/185 S

[56] References Cited

U.S. PATENT DOCUMENTS

| | | | |
|---|---|---|---|
| 1,744,383 | 1/1930 | Hessel | 362/249 |
| 2,242,597 | 5/1941 | Quandee | 362/123 |
| 2,453,695 | 11/1948 | Belling | 362/123 |
| 2,474,356 | 6/1949 | Harris | 362/252 |
| 2,759,095 | 8/1956 | Kline | 362/123 |
| 2,969,456 | 1/1961 | Raymaley | 362/123 |
| 3,118,618 | 1/1964 | Holbrook | 362/249 |
| 3,704,366 | 11/1972 | Korb et al. | 362/123 |
| 3,723,723 | 3/1973 | Lerner | 362/249 |
| 3,752,407 | 8/1973 | Baugh et al. | 362/123 |
| 3,770,951 | 11/1973 | Corelli et al. | 362/249 |
| 4,462,065 | 7/1984 | Rhodes | 362/123 |
| 4,516,193 | 5/1985 | Murphy | 362/123 |
| 4,720,773 | 1/1988 | Ahroni | 362/123 |
| 4,736,282 | 4/1988 | Ahroni | 362/123 |
| 4,870,547 | 9/1989 | Curcefix | 362/123 |
| 5,150,963 | 9/1992 | Hill | 362/123 |
| 5,422,801 | 6/1995 | Sangalli, Jr. | 362/252 |
| 5,488,549 | 1/1996 | Miller et al. | 362/123 |

FOREIGN PATENT DOCUMENTS

| | | | |
|---|---|---|---|
| 837726 | 6/1960 | United Kingdom | 362/123 |

*Primary Examiner*—Ira S. Lazarus
*Assistant Examiner*—Matthew Spark

[57] ABSTRACT

A Christmas tree light ring including a securing clamp for snugly securing to the trunk of a tree, a circular power member with an opening larger than the securing clamp, and a plurality of support posts connecting at their upper ends to the securing clamp and at their lower ends to the circular power member. The support posts extend downwardly and outwardly from the securing clamp to the circular power member to support the circular power member at a position spaced radially outward from the tree trunk. The circular power member has a plurality of electrical connector sockets therein, and a plurality of light strands have electrical connector plugs which are removably connectable to the sockets of the circular power member so that the light strands may depend therefrom. Optionally, a tree topper ornament is provided for the placing on the top of the tree trunk and is also adapted to draw power from the circular power member. A power supply cord provides power to the circular power member from a wall electrical outlet.

8 Claims, 3 Drawing Sheets

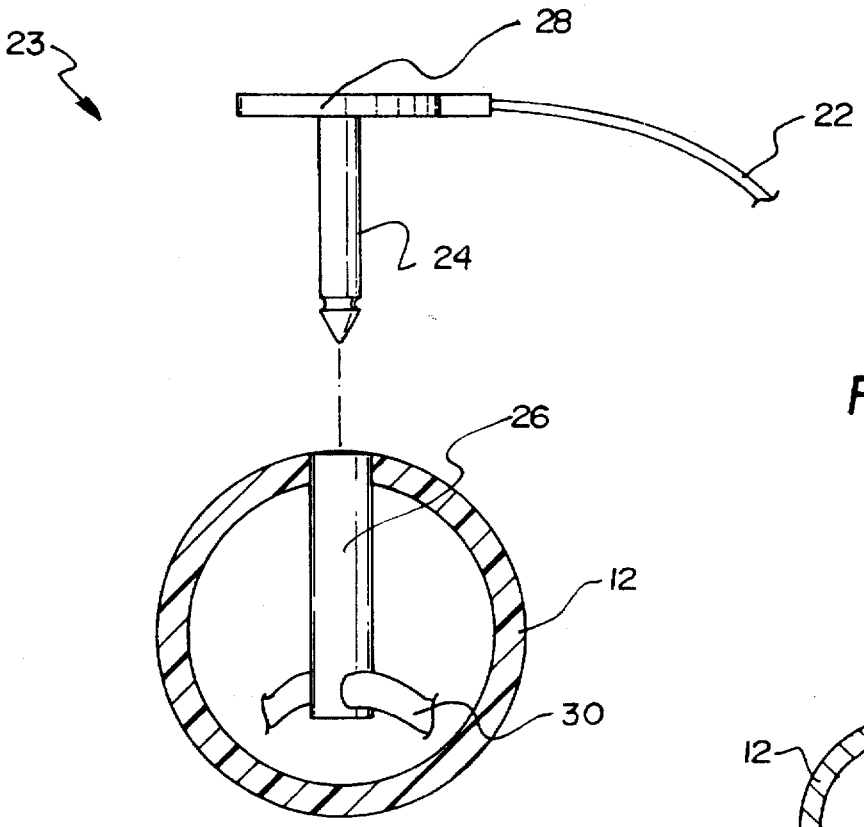
Fig. 5
Fig. 5a
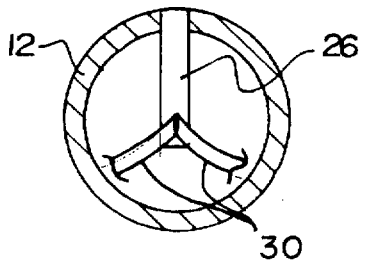
Fig. 6
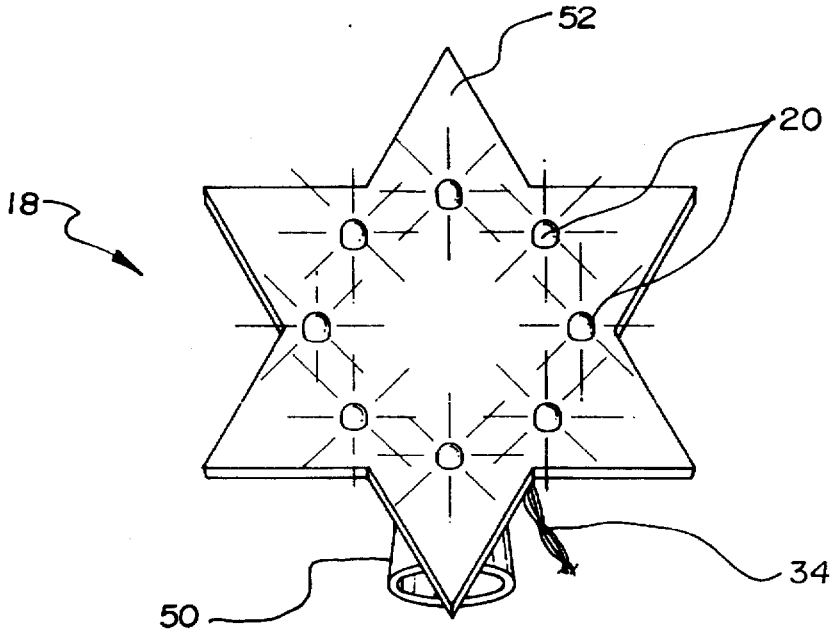

CHRISTMAS TREE LIGHT RING

BACKGROUND OF THE INVENTION

1. Field of the Invention

The present invention relates to Christmas decorations and more particularly pertains to a new Christmas Tree Light Ring for quickly and easily decorating a Christmas tree or pole or the like by eliminating light strand entanglement while offering a fully separable and serviceable system.

2. Description of the Prior Art

The use of Christmas decorations is known in the prior art. More specifically, Christmas decorations heretofore devised and utilized are known to consist basically of familiar, expected and obvious structural configurations, notwithstanding the myriad of designs encompassed by the crowded prior art which have been developed for the fulfillment of countless objectives and requirements.

Known prior art Christmas decorations include U.S. Pat. No. 5,057,976 issued to DuMong on 15 Oct. 1991; U.S. Pat. No. 4,736,282 issued to Ahroni on 5 Apr. 1988; U.S. Pat. No. 5,422,801 issued to Sangalli, Jr. on 6 Jun. 1995; U.S. Pat. No. 5,226,709 issued to Labranche on 13 Jul. 1993; and U.S. Pat. No. 4,620,270 issued to Laakso on 28 Oct. 1986.

While these devices fulfill their respective, particular objectives and requirements, the aforementioned patents do not disclose a new Christmas Tree Light Ring. The inventive device includes a power circle, a securing clamp, support posts, light strands, and coaxial connectors.

In these respects, the Christmas Tree Light Ring according to the present invention substantially departs from the conventional concepts and designs of the prior art, and in so doing provides an apparatus primarily developed for the purpose of quickly and easily decorating a Christmas tree or pole or the like by eliminating light strand entanglement while offering a fully separable and serviceable system.

SUMMARY OF THE INVENTION

In view of the foregoing disadvantages inherent in the known types of Christmas decorations now present in the prior art, the present invention provides a new Christmas Tree Light Ring construction wherein the same can be utilized for quickly and easily decorating a Christmas tree or pole or the like by eliminating light strand entanglement while offering a fully separable and serviceable system.

The general purpose of the present invention, which will be described subsequently in greater detail, is to provide a new Christmas Tree Light Ring apparatus and method which has many of the advantages of the Christmas decorations mentioned heretofore and many novel features that result in a new Christmas Tree Light Ring which is not anticipated, rendered obvious, suggested, or even implied by any of the prior art Christmas decorations, either alone or in any combination thereof.

To attain this, the present invention generally comprises a power circle, a securing clamp, support posts, light strands, and coaxial connectors.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Christmas Tree Light Ring apparatus and method which has many of the advantages of the Christmas decorations mentioned heretofore and many novel features that result in a new Christmas Tree Light Ring which is not anticipated, rendered obvious, suggested, or even implied by any of the prior art Christmas decorations, either alone or in any combination thereof.

It is another object of the present invention to provide a new Christmas Tree Light Ring which may be easily and efficiently manufactured and marketed.

It is a further object of the present invention to provide a new Christmas Tree Light Ring which is of a durable and reliable construction.

An even further object of the present invention is to provide a new Christmas Tree Light Ring which is susceptible of a low cost of manufacture with regard to both materials and labor, and which accordingly is then susceptible of low prices of sale to the consuming public, thereby making such Christmas Tree Light Ring economically available to the buying public.

Still yet another object of the present invention is to provide a new Christmas Tree Light Ring which provides in the apparatuses and methods of the prior art some of the advantages thereof, while simultaneously overcoming some of the disadvantages normally associated therewith.

Still another object of the present invention is to provide a new Christmas Tree Light Ring for quickly and easily decorating a Christmas tree or pole or the like by eliminating light strand entanglement while offering a fully separable and serviceable system.

Yet another object of the present invention is to provide a new Christmas Tree Light Ring which includes a power circle, a securing clamp, support posts, light strands, and coaxial connectors.

Still yet another object of the present invention is to provide a new Christmas Tree Light Ring that is ornamentally desirable.

Even still another object of the present invention is to provide a new Christmas Tree Light Ring that adds to the enjoyment and excitement of Christmas by making Christmas tree decoration a joy rather than a chore.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 and 5*a* are cross sectional views taken along line 5—5 of FIG. 3. FIG. 5 shows series wiring where 5*a* shows parallel wiring.

FIG. 6 is an enlarged detail view of a tree topper of the present invention.

DESCRIPTION OF THE PREFERRED EMBODIMENT

Figure 1:
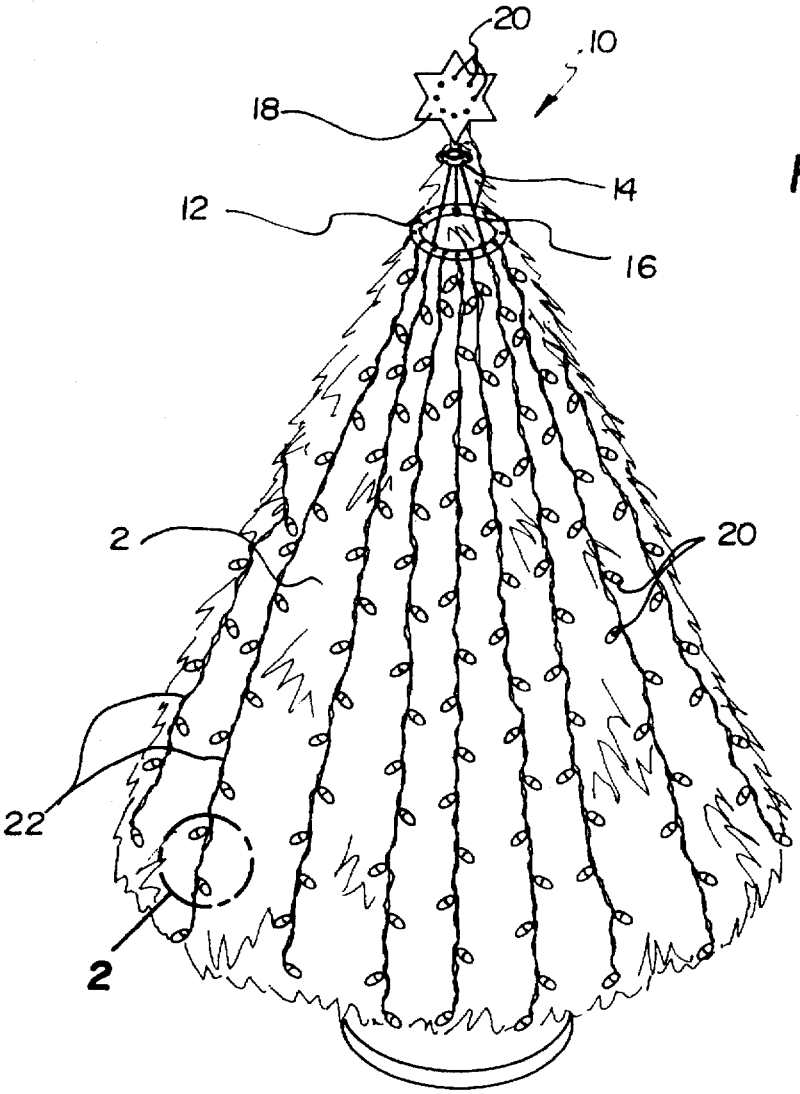
FIG. 1 is a front perspective view of a new Christmas Tree Light Ring in use according to the present invention.
Figure 2:
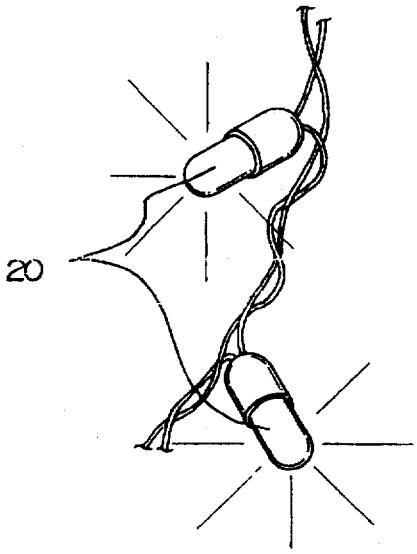
FIG. 2 is an enlarged detail view of a section of a light strand of the present invention.

With reference now to the drawings, and in particular to FIGS. 1 through 6 thereof, a new Christmas Tree Light Ring embodying the principles and concepts of the present invention and generally designated by the reference numeral 10 will be described.

Figure 3:
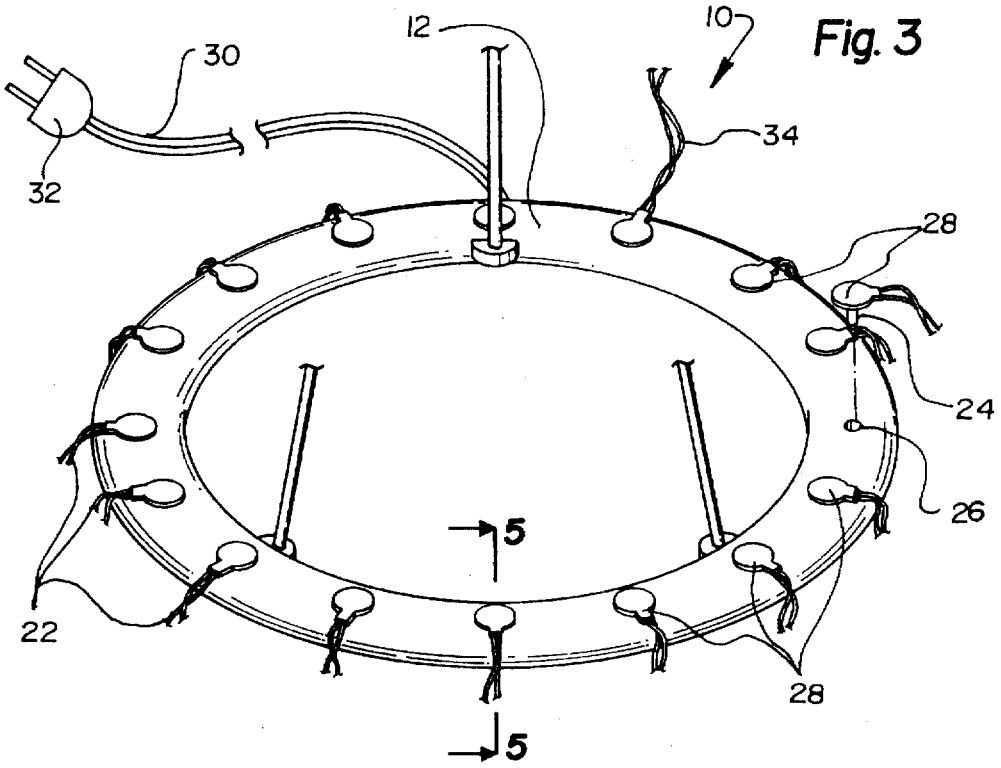
FIG. 3 is an enlarged detail view of a new Christmas Tree Light Ring of the present invention.

More specifically, referring to FIG. 3, it will be noted that the Christmas Tree Light Ring 10 comprises a power circle 12, a securing clamp 14, support posts 16, light strands 22, and coaxial connectors 23. The power circle 12 is connected to the support posts 16 with the support posts 16 extending up from the power circle 12. Also, referring to FIG. 4, the support posts 16 are also adjoined to the securing clamp 14 where the securing clamp 14 further includes post apertures 17 for this purpose.

Figure 4:
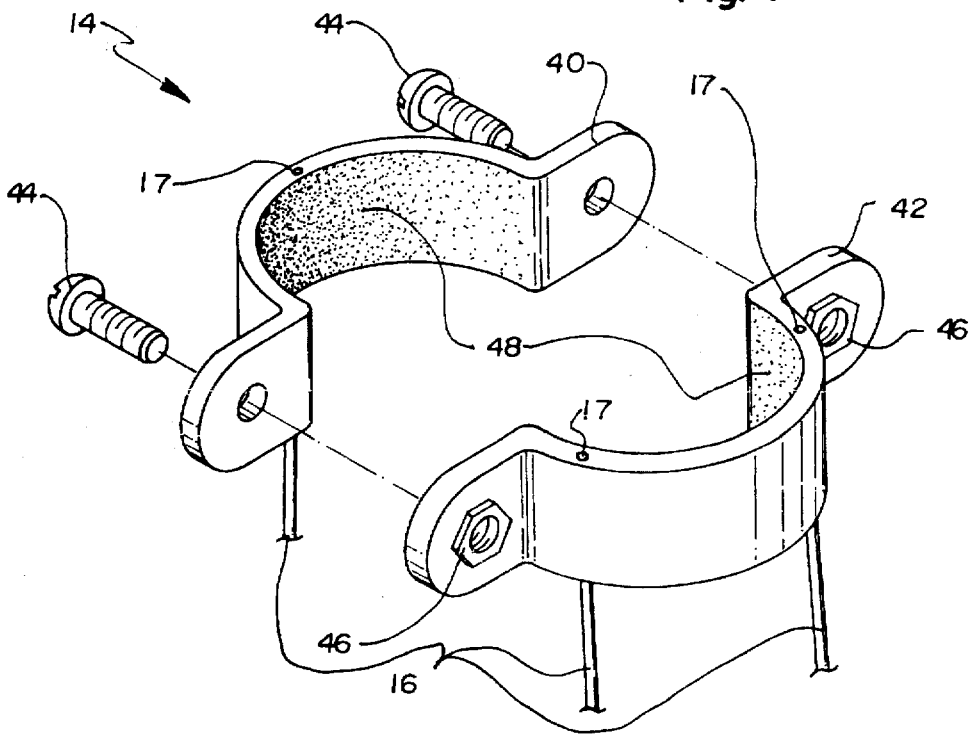
FIG. 4 is an enlarged detail view of a securing clamp of the present invention.

The securing clamp 14, referring to FIG. 4, is comprised of a first clamp half 40 and a second clamp half 42 which are detachably held together by at least one clamp screw 44 and a clamp nut 46. The securing clamp 14 further comprises a clamp surface 48 for the purpose of gripping a pole shaft or the Christmas tree 2.

The power circle 12, referring to FIGS. 1, 3, and 6, is powered by a power supply cord 30 and supplies power to a tree topper 18 by way of a topper power supply cord 34. The power supply cord 30 includes a typical power supply plug 32 for insertion into ordinary household power. The tree topper 18 further includes a tree top cup 50 for fitting over and onto the top of a Christmas tree 2. Furthermore, the tree topper 18 also comprises a tree top ornament 52.

Referring to FIGS. 3, 5, and 5*a*, the coaxial connectors 23 are further comprised of light strand plugs 28 at one end of each light strand 22, wherein each light strand plug 28 further includes a coaxial power pin 24. The power circle 12 also includes a plurality of coaxial power apertures 26 which receive the coaxial power pins 24 and where the power supply cord 30 is connected to each coaxial power aperture 26, either in series as shown in FIG. 5 or in parallel a shown in FIG. 5*a*. Each light strand 22 ordinarily includes a plurality of lights 20.

As best illustrated in FIGS. 1 through 6, it can be shown that the Christmas Tree Light Ring 10 using coaxial connectors 23 can be used to quickly decorate a Christmas tree 2 in an organized orderly manner not previously known within this art. The power circle 12 is preferably made of a tubular structure that allows the power supply cord 30 to be contained and routed within it. In addition to this, the coaxial power aperture 26 is preferably made of a tube-like structure as well, allowing the power supply cord 30 to be fastened to the coaxial power aperture 26 and allowing the coaxial power aperture 26 to be fixed to the power circle 12 and extend into the power circle 12.

In use, the power circle 12 along with the securing clamp 14 are fixed to and near the top of a Christmas tree 2. The tree topper 18 is positioned onto the top of the Christmas tree 2 and light strands 22 by way of light strand plugs 28 are plugged into the power circle 12 and hang therefrom. The tree topper 18 is also plugged into the power circle 12 by way of the topper power supply cord 34. Finally the power supply cord 30 is plugged into a wall outlet by way of the power supply plug 32 and the Christmas tree is illuminated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Christmas tree light ring system for mounting on a tree having a central trunk and radiating branches, said system comprising:

a securing clamp for securing about the central trunk of a tree, said securing clamp having an aperture for snugly receiving and embracing the trunk of a tree;

a circular power member having a plurality of electrical connector sockets therein and a central opening for receiving a portion of the trunk of a tree upon which said securing clamp is mounted, said central opening being sufficiently large such that said central member is located at a radially spaced relationship to said tree trunk;

a plurality of light strands, each said light strand having a plurality of lights thereon and an electrical connector plug for connecting to one of said electrical connector socket of said circular power member; and a plurality of substantially stiff support posts, each said support post being connected at an upper end to said securing clamp and at a lower end to said circular power member, said supports posts extending in an downward and radially outward relationship from said securing clamp to said circular power member to support said circular power member at a position spaced radially outward from the trunk of said tree without requiring support for said circular power member from the branches of said tree;

wherein the securing clamp comprises a first semicircular clamp half and a second semicircular clamp half and fastener means for removably fastening said first and second clamp halves together.

2. The Christmas tree light ring system of claim 1 wherein each half of the securing clamp further comprises a spaced end portions and a securing flange mounted at each end portion.

3. The Christmas tree light ring system of claim 1 wherein the circular power includes electrical wire means electrically connecting the electrical connector sockets of said power member, and a power supply cord electrically connected to said electrical wire means.

4. The Christmas tree light ring system of claim 1 additionally comprising a tree topper ornament having a power supply cord with an electrical connector plug for connecting to an electrical connector socket of said circular power member.

5. The Christmas tree light ring system of claim 1 wherein said tree topper ornament includes a substantially conical mounting member for receiving the top tip of the central trunk of a tree, and wherein said tree topper ornament is adapted to rest upon the securing clamp when clamped on the central trunk of a tree.

6. The Christmas tree light ring system of claim 1 wherein said electrical connector sockets are substantially uniformly spaced along the circumference of said circular power member.

7. The Christmas tree light ring system of claim 1 wherein the circular power member comprises a tubular structure housing said electrical wire means therein.

8. A Christmas tree light ring system for mounting on a tree having a central trunk and radiating branches, said system comprising:

a securing clamp for securing about the central trunk of a tree, said securing clamp having an aperture for snugly receiving the trunk of a tree;

a circular power member having a plurality of electrical connector sockets therein and a central opening for receiving the trunk of a tree upon which said securing clamp is mounted, said central opening being sufficiently large such that said central member is located at a radially spaced relationship to said tree trunk;

a plurality of light strands, each said light strand having a plurality of lights thereon and an electrical connector plug for connecting to one of said electrical connector socket of said circular power member; and a plurality of substantially stiff support posts, each said support post being connected at an upper end to said securing clamp and at a lower end to said circular power member, said supports posts extending in an downward and radially outward relationship from said securing clamp to said circular power member to support said circular power member at a position spaced radially outward from the trunk of said tree without requiring support for said circular power member from the branches of said tree;

wherein the securing clamp comprises a first semicircular clamp half and a second semicircular clamp half, and fastener means for removably fastening said first and second clamp halves together;

wherein each half of the securing clamp further comprises a spaced end portions and a securing flange mounted at each end portion;

wherein the circular power includes electrical wire means electrically connecting the electrical connector sockets of said power member, and a power supply cord electrically connected to said electrical wire means;

a tree topper ornament having a power supply cord with an electrical connector plug for connecting to an electrical connector socket of said circular power member; and wherein said electrical connector sockets are substantially uniformly spaced along the circumference of said circular power member;

wherein the circular power member comprises a tubular structure housing said electrical wire means therein; and wherein said tree topper ornament includes a substantially conical mounting member for receiving the top tip of the central trunk of a tree, and wherein said tree topper ornament is adapted to rest upon the securing clamp when clamped on the central trunk of a tree.

* * * * *